US007988103B2

(12) United States Patent
Land, III et al.

(10) Patent No.: US 7,988,103 B2
(45) Date of Patent: Aug. 2, 2011

(54) SOLID STATE SUPERSONIC FLOW ACTUATOR AND METHOD OF USE

(75) Inventors: H. Bruce Land, III, Laurel, MD (US); Kenneth R. Grossman, Olney, MD (US); Bohdan Z. Cybyk, Columbia, MD (US); David M. VanWie, Brookeville, MD (US)

(73) Assignee: John Hopkins University, Baltimore, MD (US)

( * ) Notice: Subject to any disclaimer, the term of this patent is extended or adjusted under 35 U.S.C. 154(b) by 781 days.

(21) Appl. No.: 12/015,142

(22) Filed: Jan. 16, 2008

(65) Prior Publication Data

US 2010/0284825 A1 Nov. 11, 2010

Related U.S. Application Data

(60) Provisional application No. 60/881,353, filed on Jan. 19, 2007, provisional application No. 60/886,155, filed on Jan. 23, 2007.

(51) Int. Cl.
*B64C 21/08* (2006.01)

(52) U.S. Cl. ..... 244/207

(58) Field of Classification Search ..... 244/207–209, 244/205

See application file for complete search history.

(56) References Cited

U.S. PATENT DOCUMENTS

| | | | |
|---|---|---|---|
| 3,095,163 | A | 6/1963 | Hill |
| 3,356,897 | A | 12/1967 | Barr, Jr. et al. |
| 4,749,151 | A | 6/1988 | Ball et al. |
| 4,805,400 | A | 2/1989 | Knowles |
| 6,202,304 | B1 | 3/2001 | Shatz |
| 6,375,118 | B1 | 4/2002 | Kibens et al. |
| 6,457,654 | B1 | 10/2002 | Glezer et al. |
| 6,554,607 | B1 | 4/2003 | Glezer et al. |
| 6,805,325 | B1 | 10/2004 | Malmuth et al. |
| 6,872,259 | B2 | 3/2005 | Strang |
| 6,888,314 | B2 | 5/2005 | Krichtafovitch et al. |
| 6,924,401 | B2 | 8/2005 | Giapis et al. |
| 6,987,364 | B2 | 1/2006 | Petrmichl |
| 7,002,126 | B2 | 2/2006 | Gnemmi et al. |
| 7,017,863 | B2 | 3/2006 | Scott et al. |
| 7,066,431 | B2 | 6/2006 | Scott et al. |
| 7,380,756 | B1 | 6/2008 | Enloe et al. |
| 2004/0021041 | A1 | 2/2004 | Grossman et al. |
| 2007/0119827 | A1 | 5/2007 | Miller et al. |

FOREIGN PATENT DOCUMENTS

| | | |
|---|---|---|
| EP | 1767894 | 3/2007 |
| RU | 2271307 | 3/2006 |

*Primary Examiner* — Galen Barefoot
(74) *Attorney, Agent, or Firm* — Aisha Ahmad

(57) ABSTRACT

A method and device are provided for manipulating high-speed flows without moving aerodynamic structures. More particularly, a flow control actuator device is provided that is capable of producing a pulsating synthetic jet with high exhaust velocities for manipulating high-speed flows without moving aerodynamic structures. The high exhaust velocities of the actuator device may reach sonic levels of Mach 1 or greater. In one embodiment, the device may be constructed as an array of devices. In such an embodiment, each individual device is preferably reduced to a very small size. In such an embodiment, each individual device can then be fired in temporal patterns to create high-speed synthetic jets of air extending above the surface of the each device.

6 Claims, 10 Drawing Sheets

SOLID STATE SUPERSONIC FLOW ACTUATOR AND METHOD OF USE

CROSS REFERENCE TO RELATED APPLICATIONS

This application claims the benefit of prior filed, U.S. provisional applications: Ser. No. 60/881,353, filed on Jan. 19, 2007; and Ser. No. 60/886,155 filed on Jan. 23, 2007, which is incorporated herein by reference in its entirety.

STATEMENT OF GOVERNMENT INTEREST

This invention was made with Government support under United States Air Force contract number FA 9550-04-01-0095. The Government has certain rights in the invention.

BACKGROUND OF THE INVENTION

1. Field of the Invention

The invention relates generally to the control of flow phenomena, and more particularly, but not exclusively, to a robust flow control actuator capable of influencing supersonic boundary flow phenomena.

2. Description of the Related Art

Active flow control is regarded as an enabling technology for many advanced air vehicle concepts under consideration. Effective manipulation of a flow field can lead to a number of significant benefits for aerospace vehicles, including enhanced performance, maneuverability, payload, and range, as well as lowered overall cost. These macro benefits are directly achievable through the application of transition, turbulence and flow separation. Organizations such as the United States Air Force and NASA continue to investigate the potential advantages of active flow control over more traditional aerodynamic techniques.

Steering an aerodynamic body results from inducing asymmetric body forces typically produced by some sort of flow control technology. In one approach, commands from a control system vary the power into an actuator. As is well known to those skilled in the art of fluid dynamics, flows over aerodynamic surfaces typically have a high-sensitivity region, where a minimum actuator input will produce a maximum fluidic change. The flow phenomena to be controlled could be related to laminar-to-turbulent boundary layer transition, the separation of boundary layers, or acoustic disturbances. It could also be related to the control of vortices, jet vectoring, mixing or steering. An actuator for controlling the flow phenomena can be constructed based on any one of a variety of existing technologies, including, for example, fluidics, thermodynamics, acoustics, piezo-electric elements, synthetic jets, electromagnetics or Micro-Electro-Mechanical systems (MEMS).

Presently, several classes of micro-actuators are under investigation for flow control applications associated with aerospace vehicle systems. A majority of these micro-actuators use mechanical deflection of control surfaces, mass injection, or synthetic jets to manipulate boundary layer interactions. Other actuators manipulate electromagnetic fields in an attempt to control flow. Each has significant limitations for applications involving supersonic flows.

Mechanical actuators include electroactive polymers, shape memory alloys, electro-active ceramics, and MEMS. These actuators control flow by movement of a control surface to physically change the camber of an airfoil, thus changing the lift of a wing, for example. Manipulation of surface texture via MEMS tabs can induce vortices on the leading edge of a wing that affect its lift Mass injection devices include combustion-driven jet actuators, which burn a gaseous fuel-air mixture. A chamber is filled with a combustible mixture and then ignited, resulting in high pressures inside the chamber and mass expulsion through the chamber orifice. Combustion-driven jet actuators require a considerable amount of auxiliary equipment to function. A fuel source is needed. Fuel must be pumped to the point of use, metered for the proper fuel air mixture, and injected into the combustion chamber. There a precisely timed ignition source must occur to ignite the fuel. The required fuel supply, plumbing, pumps, metering devices, fuel, injectors, ignition devices, timing devices, etc. significantly complicate this approach to jet actuators. Additionally it is difficult to perform these auxiliary tasks at the macro level required for the jet actuators.

Synthetic jet actuators are fluidic control devices that transfer momentum into the external system without net mass transfer. Actuators, such as synthetic jets, that operate without net mass transfer are known as zero net mass flux (ZNMF) devices. They have been shown to be effective for low-speed (subsonic) flows, but in the past did not have the required mass flow output and high frequency for supersonic flow applications. They typically use a piezo-electric diaphragm in a cavity opposite an orifice. The oscillatory motion of the diaphragm alternately decreases the cavity volume, expelling gas, and then increases the cavity volume, refilling the cavity with gas. The oscillation frequency of piezoelectric diaphragms are governed by their size, displacement, and mass. The smaller the diaphragm the higher the frequency at which it can oscillate. Unfortunately the smaller the diaphragm the smaller the diaphragm and mass displacement and thus the smaller the jet momentum flux. Since piezo-electric diaphragms have a small displacement they need a large area to displace a useful amount of air from the cavity. This is counter productive to achieving the high frequency operation and limits the piezo-electric units to low frequency operation of a few hundred cycles per second. Small piezo-electric diaphragms can achieve frequencies in the kilohertz range, but can't produce the displacements necessary to move enough air for effective synthetic jet operation. Large power supplies are typically required to achieve the high rate of change in voltage needed to drive these piezo-electric devices. Additionally the device includes moving parts which can fatigue and fail.

Each of the afore-mentioned actuators has significant limitations for applications related to supersonic flow control in terms of the combined operating frequency and momentum flux necessary for supersonic flow applications. Accordingly, a need exists for a robust flow control actuator that is capable of influencing supersonic boundary layers.

SUMMARY OF THE INVENTION

Therefore, the present invention has been made in view of the above problems. Accordingly, the present invention provides a method and device for manipulating high-speed flows without moving aerodynamic structures. More particularly, a flow control actuator device is provided that is capable of producing a pulsating synthetic jet with high exhaust velocities for manipulating high-speed flows without moving aerodynamic structures. The high exhaust velocities of the actuator device may reach sonic levels on the order of Mach 1 or higher. Further, the momentum throughput (i.e., mass flow) is much higher than the piezo-electric diaphragms of the prior art, and the device qualifies as a zero net mass flux (ZNMF) device.

In one embodiment, the flow control actuator device, sometimes referred to herein as a repetitive spark micro-actuator (RSMA), is comprised of a small chamber including at least two electrodes and a discharge orifice. In accordance with a method of operation, the RSMA is capable of creating high pressure in the chamber by using an electrical discharge to create plasma inside of the chamber, rapidly heating air and expelling it through an orifice. Pressure is relieved by exhausting the heated air through the discharge orifice. Sufficient driving pressure is created by the exhausted air to influence supersonic boundary layers. Unlike combustion-driven jet actuators which require a fuel source limiting the operational life of the actuator, the RSMA device of the invention recycles air and requires no fuel source. In this manner, the RSMA is a zero net mass flux (ZNMF) device, similar to a synthetic jet actuator and is distinguishable from a mass injection device.

In one embodiment, the RSMA may be constructed as an array of such devices. In such an embodiment, each individual RSMA is preferably reduced to a very small size, for example, on the order of 2 mm to 10 mm in an embodiment, with associated electronics being similarly reduced and mounted to the back of an individual RSMA device. Given such an array, a large number of capacitors can be simultaneously charged from a single main power supply. Each individual RSMA can then be fired in temporal patterns to create high-speed synthetic jets of air extending above the surface of the RSMA.

As will be apparent, the device of the present invention provides numerous advantages over conventional mechanical-based devices. For example, the RSMA are much smaller than mechanical actuators and contain no moving parts to fatigue and fail. The smaller weight and higher reliability allow weight savings, quicker aerodynamic response and higher reliability over mechanical systems.

Beneficially, the RSMA is capable of producing air jets with velocities at least an order of magnitude higher than other known synthetic actuators, enabling new applications. Potential new applications include, for example, replacing fins on missiles, steering munitions in flight without mechanical control surfaces, airflow control in aggressive-turn turbine engine inlets, compressor blade tip leakage mitigation in gas turbine engines, turbine blade tip leakage mitigation, cargo bay resonance control, for commercial and military aircraft, steering control for high angle-of-attack missiles, steering control for atmospheric re-entry vehicles and steering control for maneuvering projectiles.

Further advantages of the invention include the ability to incorporate multiple RSMAs into easily formed RSMA arrays of actuators, which can be operated individually or in patterns. By firing the individual RSMAs in pre-defined temporal patterns, high-speed synthetic jets of air are expelled extending above the surface of the device to create an "air curtain". RSMA arrays, when placed at critical points and operated together, can produce forces that can be used to replace aerodynamic steering devices by initiating macro-scale effects. In one application, arrays of RSMAs can be used to form a pressure seal between moving parts with small amounts of clearance between the parts, such as the gap between the tip of a compressor blade and its housing.

BRIEF DESCRIPTION OF THE DRAWINGS

These and other objects, features and advantages of the invention will be apparent from a consideration of the following Detailed Description Of The Invention considered in conjunction with the drawing Figures, in which.

DETAILED DESCRIPTION OF THE PREFERRED EMBODIMENTS

Figure 1:
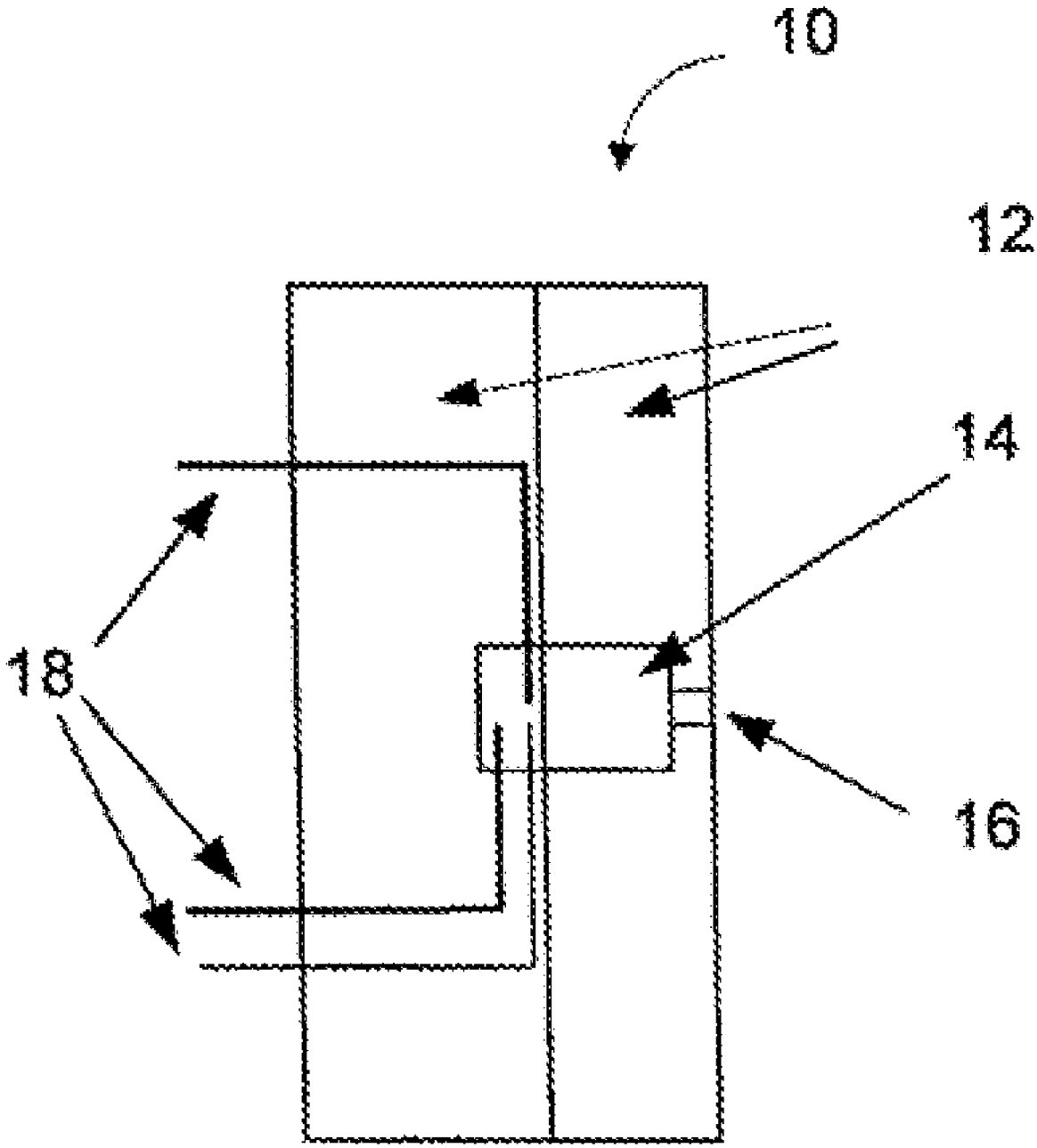
FIG. 1 shows a cutaway side view of a repetitive spark micro-actuator (RSMA) device, according to one embodiment.

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail.

It should be appreciated that the present invention can be implemented in numerous ways, including as a process, an apparatus, a system, a device and a method. Several inventive embodiments of the present invention are described below.

The present application is generally divided into six sections. An overview is presented in the first section. A device description is provided in the second section. A single cycle of operation of the RSMA device is described in section three. Section four describes and illustrates different electrical circuits contemplated for use with the RSMA device 10. The fifth section describes representative electrodes. All of this is combined into complete arrays of devices which are described in section six.

I. Overview

In accordance with the present invention, there are provided herein a repetitive spark micro-actuator (RSMA) for manipulating high-speed flows without moving aerodynamic structures. In an embodiment, the synthetic jet actuator is embodied as a cavity device for providing active flow control. Disturbances produced by such a cavity device take advantage of fluid phenomena such as transition, turbulence, and flow separation. Conversely, these disturbances can also be used to study the development of such phenomena. For example, electrical discharges in a recessed cavity have been used in experiments to generate artificial disturbances for the study of laminar-to-turbulent transition. The disturbance frequencies were at levels typically needed for active flow control.

The synthetic jet actuator of the invention provides capabilities for producing a synthetic jet with high exhaust velocities for manipulating high-speed flows without moving aerodynamic structures. The synthetic jet actuator manipulates high-speed flows without moving structures and generates exhaust streams capable of penetrating supersonic, as well as subsonic, boundary layers, without the need for active mechanical components.

It is instructive to distinguish the synthetic jet produced by the RSMA device of the invention from other pulsating jets, such as those commonly used in printers. Ink jet printer heads pulse liquid but rely on a reservoir of ink and use capillary action to suck a small amount of fluid (ink) into a cavity for each pulse. Because the ink jet permanently expels mass that is not recaptured and because the ink jet has a finite lifespan limited by its fuel capacity, it is not classified as a synthetic jet. The synthetic jet produced by the RSMA device of the invention uses gas, and unlike ink jets has no net mass exchange. As such, its lifespan is theoretically infinite.

II. RSMA Device

FIG. 1 is a cutaway side view of an illustration of a flow control actuator device, referred to by the inventors as a repetitive spark micro-actuator (RSMA) device 10. The device 10 is comprised of a body 12 which may be constructed of an inorganic insulator such as a ceramic insulator. In other embodiments, the body 12 may be constructed of a conductive material as long as the electrodes 18 are insulated from the body 12. The body 12 is further comprised of a cavity 14 and a discharge orifice 16. At least two electrodes 18 (three are shown) are placed with their tips closely spaced within the cavity 14. The discharge orifice 16 may be machined as a simple drilled hole. Alternatively, it can be fabricated with tapers on the inner and outer sides so that a converging-diverging nozzle is created, resulting in better flow characteristics. The minimum practical orifice size is driven by viscous effects directly within the orifice section.

Figure 2A:
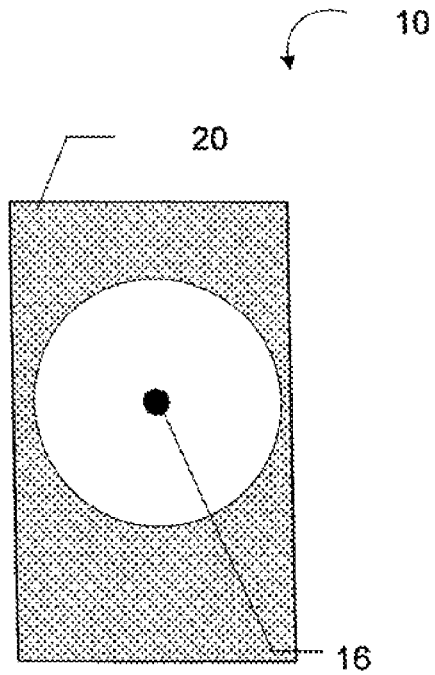
FIGS. 2*a* and 2*b* show respective side and front views of a repetitive RSMA device 10 of FIG. 1, according to one embodiment.
Figure 2B:
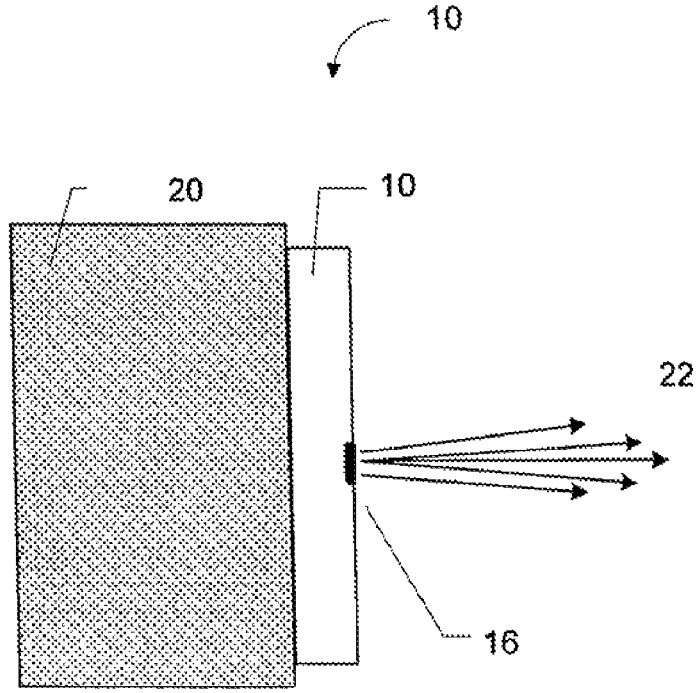

FIGS. 2*a* and 2*b* show respective side and front views of the spark micro-actuator (RSMA) device 10 of FIG. 1.

FIG. 2*a* shows a centrally located discharge orifice 16 and electronics 20 for initiating a repetitive spark within the RSMA device 10.

FIG. 2*b* illustrates a side view showing the electronics 20 and hot gases 22 which exit from the orifice 16 when the RSMA device 10 is in operation.

In one exemplary embodiment, the RSMA device has an orifice diameter of substantially 0.33 mm (0.013 inches) and a chamber volume of substantially 4.22 E-8 $m^3$. A capacitor potential of substantially 1000 Volts is used to initiate a spark inside of the chamber.

III. Single Cycle of Operation of an RSMA Device

Figure 3:
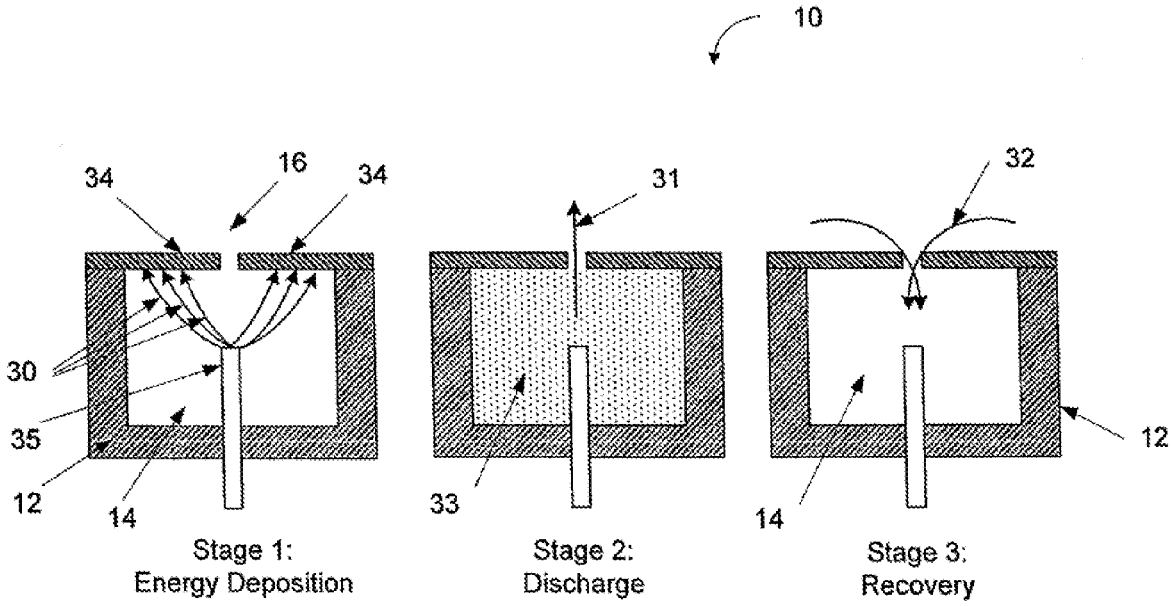
FIG. 3 illustrates a typical operation of a single cycle of operation of an RSMA device, according to one embodiment.

FIG. 3 is an illustration of an exemplary single cycle of operation of an RSMA device 10, according to one embodiment. As shown, operation of the RSMA device 10 is comprised of three essential stages, an energy deposition stage, a discharge stage and a recovery stage. It should be appreciated that this single cycle is repeated continuously to create a synthetic jet capable of causing a macro-scale flow effect when positioned in a region of high receptivity. The RSMA device 10 transfers momentum with the desired external effect when positioned in a region of high receptivity. The device transfers momentum with the external surroundings without net mass transfer. It should be understood that the amount of mass expelled during each cycle of operation and the velocity at which it is expelled (i.e. momentum flux) is large compared to that of a conventional piezoelectric device.

Stage 1—Energy Deposition

In the energy deposition stage, stage 1, a very high electric current is discharged between two or more electrodes 34 and 35 within the chamber 14 of the RSMA device. The electrodes 34, 35 are isolated and supported by an insulator 12. The discharge currents can reach hundreds of amps. This arc 30 creates plasma, rapidly heating the air inside of the RSMA device and creating a high chamber pressure, which can range substantially from 300 to 1.000 PSI, depending upon a particular design configuration. Chamber pressures in excess of 1000 PSI are also realizable.

Stage 2—Discharge

In the discharge stage, stage 2, the now-pressurized gas 33 in the chamber is expelled 31 through the discharge orifice 16. As flow begins, the discharge orifice 16 quickly chokes (within a few micro-seconds), and air is expelled from the device 10 at a high speed, on the order of the speed of sound. As the chamber air is expelled, chamber pressure and temperature drop. The orifice eventually unchokes, and the exhaust velocity decreases to zero.

Stage 3—Recovery

In the recovery stage, stage 3, the now-depleted chamber 14 draws fresh air 32 from outside of the device 10 into the chamber 14 and cools. The cycle is complete, and the device 10 is ready to repeat the cycle.

IV. Electrical Power Circuits

Figure 4A:
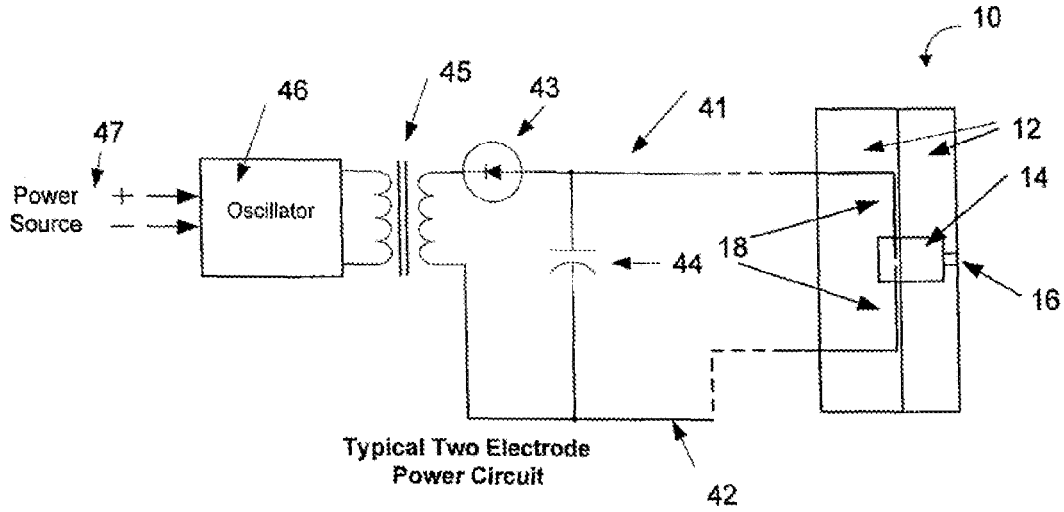
FIGS. 4*a*-4*c* are illustrations of three types power circuits that may be used with the RSMA device of FIG. 1, according to one embodiment.
Figure 4B:
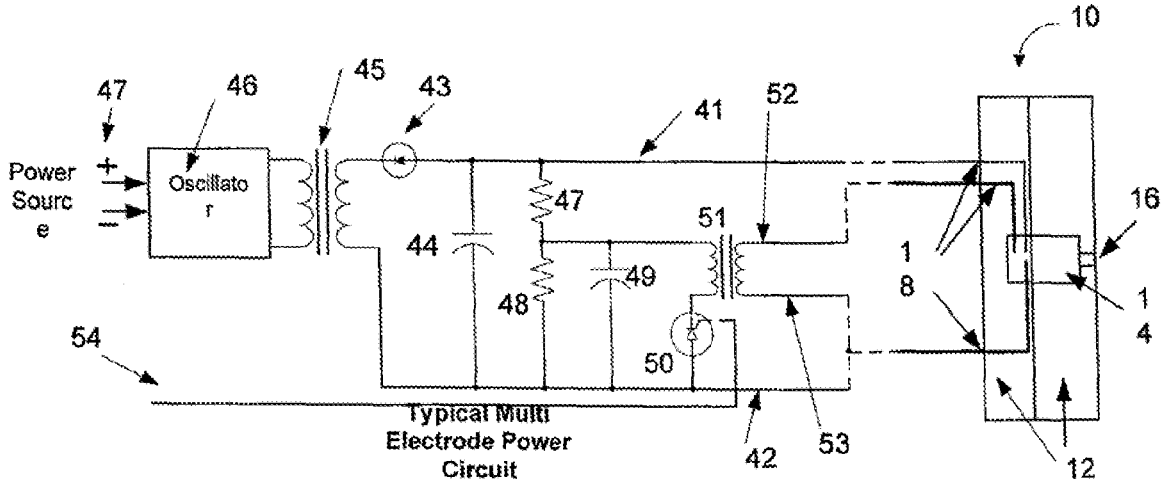
Figure 4C:
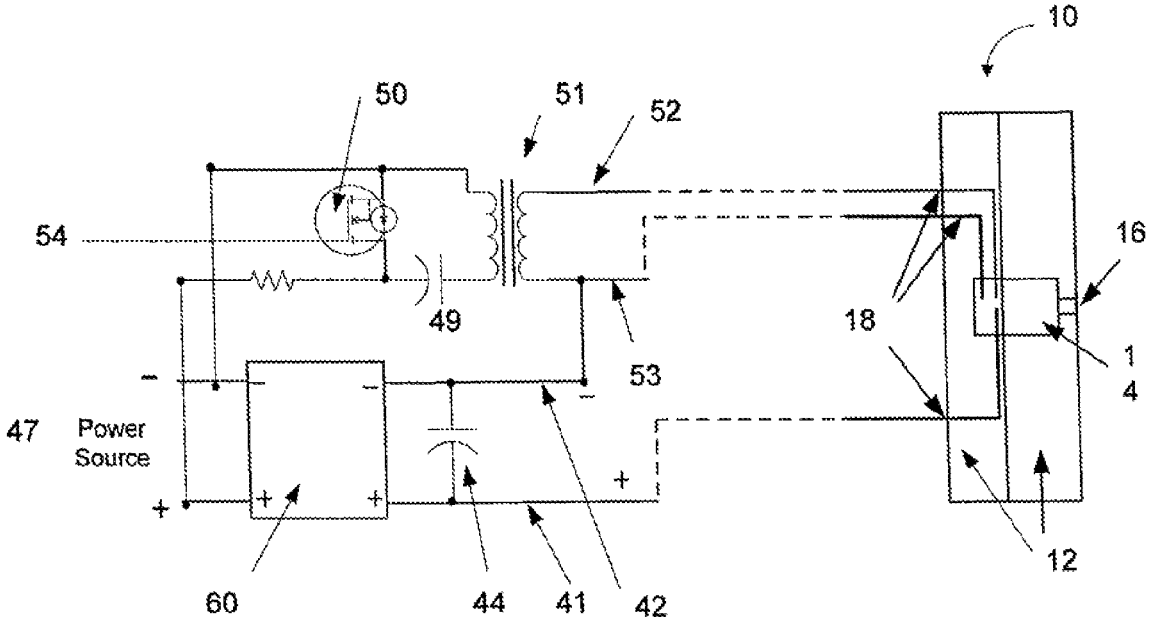

FIGS. 4*a*-4*c* are illustrations of different embodiments of electrical circuits contemplated for use with the RSMA device 10. Many types of electrical circuits are contemplated for use with the RSMA device 10 to initiate and sustain the electric discharge in the energy deposition stage.

FIG. 4*a* illustrates a two-electrode power circuit for providing a power source to initiate and sustain an electrical discharge within the RSMA 10. In this embodiment, the RSMA 10 is arranged using two electrodes 18 in the device chamber 14. These two electrodes 18 are connected at one end to the output of the power circuit 41, 42. Typically a low voltage 47 is supplied to an oscillator 46. The output of the oscillator 46 is connected to the input of a step up voltage transformer 45. The output of the step up voltage transformer 45 it is rectified by a diode 43 to become a DC voltage of several thousand volts. The combination of an oscillator, transformer and diode constitute a step up DC power supply or DC to DC converter. In this case, a high voltage is applied across the two electrodes 18 as a capacitor 44 in parallel with the two electrodes 18 is charged. When the voltage on the capacitor 44 reaches a breakdown potential of the electrode gap, an arc is created. The resulting plasma deposits energy from the capacitor 44 into the chamber fluid (e.g., gas, air) until the capacitor voltage falls below that required to sustain the discharge, thus completing stage 1, the deposition stage, as described above. Once the arc in the gap has gone out the capacitor 44 begins to recharge to repeat the cycle as long as the input power 47 is present.

While the electrode configuration of FIG. 4*a* is simple in terms of its construction and operation, it suffers from variations in breakdown potential. More particularly, as voltage is applied by transformer 45 and diode 43, the transformer 45 initially sees the main capacitor 44 as a short circuit which loads the applied voltage down to zero volts. With time the capacitor 44 is charged linearly and the voltage across the capacitor and the electrodes 18 will rise. At the point in time the voltage exceeds the breakdown potential of the gap the arc across the electrodes occurs and the voltage on the capacitor 44 drops again to zero. This cycle is constantly repeated as the main capacitor 44 is charged by the transformer 45 and diode 43 and then discharged by the arc. A drawback of this configuration is that the time at which the discharge occurs depends only upon the spontaneous breakdown of the gap between the electrodes and is not controllable. Possible causes for such variations include, for example, electrode oxidation, gas temperature, gas pressure, etc.

To further illuminate this drawback by way of example, the first time the gap is fired the breakdown may occur at a given voltage, for instance 8,000 volts. As the RSMA device 10 heats up the device 10 may break down at progressively lower voltages. In some cases, one-half of the initial voltage or less. With time the electrodes 18 tend to oxidize and the breakdown voltage will rise, perhaps to a level higher than the initial voltage. If a particle of oxide breaks off, the breakdown voltage may return to a lower level. Since the energy in the capacitor 44, which translates to the energy in the arc, is given by $\frac{1}{2}CV^2$ (where C is the capacitance in Farads) this variation is breakdown voltage can result in substantial variations in arc energy, e.g., larger than a factor of 10. It is noted that for the two-electrode configuration that since the voltage at which energy deposition occurs is not controllable and the energy in the arc is proportional to the square of the voltage on the capacitor 44, the amount of energy deposited in an individual actuator is not completely controlled or repeatable. The breakdown occurs at a random time and there is no provision in the circuit for remote control, therefore the time of the discharge of an individual RSMA cannot be closely controlled or synchronized with other devices or other events.

The two electrode device requires a single power circuit output to function as both the main power for the arc within the RSMA 10 and the trigger function. Since it requires thousands of volts to mach the breakdown potential, the transformer 45, diode 43 and capacitor 44 must be rated to continuously handle thousands of volts. These high voltage requirements adversely affect the size, cost and reliability of the transformer, diode, and capacitor To overcome the drawbacks cited above, in an alternate embodiment, the RSMA 10 may include three or more electrodes. In such a configuration, the power circuit is designed with multiple specialized outputs, typically a main arc output and a trigger output. The trigger output must still reach several thousand volts, but it can now be at a much lower amperage and exist for only a short time, typically on the order of nanoseconds, rather that needing to exist continuously. Confining the trigger output to a low power and a short time allows for smaller, lighter, more reliable components. Since the main arc supply no longer has to act as a trigger, its voltage can be desirably lowered from thousands of volts to hundreds of volts. Beneficially, this results in savings of better than an order of magnitude in size and weight for the main power circuit supplying the arc power.

The three electrode embodiment provides significant advantages over the two electrode embodiment. It should be understood, however, that for both the two electrode and three electrode embodiments, the same power is needed to heat the air within the cavity 14 (see FIG. 1) and create the jet of hot gases 22 (see FIG. 2). In the three electrode embodiment this is achieved at significantly lower costs, smaller footprint and at a higher reliability. Specifically, because the main power in the two electrode device is typically 6 kV vs. the 600V of the three electrode device, the insulation on the wires and components of the two electrode device must be on the order of 10 time thicker that the three electrode device. Further, due to additional insulation thickness and the need for additional magnetic material, the 6 kV transformer of the two electrode embodiment will be much larger than the 600V transformer of the three electrode embodiment. Further, if one diode is needed for the 600V transformer of the three electrode embodiment, then the equivalent of 10 series diodes will be needed for the 6 kV transformer of the two electrode embodiment.

A typical 600V capacitor can be, for example, 0.256"× 0.217"×0.217" or 0.012 cu. Inches. The 6 kV capacitor capable of the same energy storage will be 1.75" L by 0.75" D or 0.7731 cu. Inches or 64 times larger than the 600V capacitor.

It is well known to those skilled in the art that the insulation value of air is approximately 30 kV per inch, thus the components in the 6 kV power supply require a spacing that is typically 10 times farther apart than in the 600V power supply. Moreover, the higher voltage components of the two electrode embodiment are more expensive and less reliable than the lower voltage components of the three electrode embodiment. It is therefore shown that the combined advantages of smaller size, lower weight, closer component spacing, lower cost, and higher reliability show the advantage of keeping the main arc discharge voltage as low as low as possible, thus favoring the three electrode embodiment.

The power required for the trigger is less than 1/100 the power in the main discharge. In the two electrode configuration the main power is generated at the high voltage, i.e. 6 kV, so that the main voltage will reach the required breakdown voltage of the electrodes. In the three electrode design the trigger voltage is generated separately via the use of a small dedicated trigger transformer. The size, weight, and cost of the trigger circuit are very small compared to using a 6 kV main power supply, It is therefore shown that a power supply supplying power for the two electrode configuration is required to be on the order of 50 times larger, more expensive and heavier than the three electrode configuration.

In an alternate embodiment, to overcome the problems cited above in the two electrode configuration, a third "trigger" electrode can be added to the RSMA device 10, to initiate discharge across the main pair of electrodes. This is shown by way of example in FIGS. 4B and 4C. As with the two-electrode configuration, described above, the potential of a capacitor is placed across electrodes within the cavity of the actuator. While the voltage is high, it is not sufficient to cause an electrical breakdown across the air gap. To initiate discharge, a second source with higher voltage but limited power is applied across the so-called trigger electrode and one of the main electrodes within the actuator cavity. The trigger voltage initiates a limited power electrical breakdown in the RSMA chamber. The resulting ionized gas allows electrical breakdown between the main electrodes. The capacitor 44 discharges into the chamber heating the air. This embodiment provides advantages over the two electrode embodiment in that it is possible to closely control the power and timing of each electrical discharge. The main capacitor 44 is always charged to the same voltage and then sits waiting for a trigger to occur. The trigger electrode can be excited with a voltage much higher than that required to initiate breakdown eliminating the uncertainty of varying breakdown potential found with the two-electrode configuration.

FIG. 4B illustrates one embodiment of a multiple electrode configuration with the capability for external or internal triggering of the device. Similar to the circuit of FIG. 4*a* the oscillator 46, transformer 45 and diode 43 are used to create a high-voltage DC power. In this case only several hundred volts are needed rather than the several thousand needed for the circuit of FIG. 4A. A first portion of this high voltage is used to charge the capacitor 44 across the main electrodes 41, 42 and a second portion is passed through to a voltage divider formed by two or more resistors 47 and 48 and a third portion is passed through a voltage divider created by two or more resistors 47, 48 and used to charge a second capacitor 49 termed a trigger capacitor.

A control signal 54 is applied to a solid state device 50, such as an SCR, and controls the switching of the current from the trigger capacitor 49 into the primary of a trigger transformer 51. This generates an output voltage pulse from the trigger transformer 51 of several thousand volts. The trigger voltage 52, 53 is applied to one or more of the electrodes 18 of a RSMA having three or mare electrodes. The trigger voltage creates a small low-energy, high-voltage arc between the two or more electrodes 18 which causes the main capacitor 44, which is only charged to hundreds of volts, to discharge between the main electrodes 41 42. The energy in the main discharge completes stage 1, the deposition stage, as described above. It should be noted that one of the trigger electrodes 52, 53 can be electrically connected to one of the main electrodes 41, 42 to allow the RSMA to operate with three electrodes. Since the transformer 45, diode 43, and main capacitor 44 are only charged to hundreds of volts rather than thousands of volts as in FIG. 4A, these components can be much smaller and less expensive and have increased reliability.

FIG. 4C illustrates another embodiment of a multiple electrode configuration. It this embodiment, the low voltage DC power source 47 is transformed into a high DC voltage via a DC to DC converter power supply 60 to charge the main capacitor 44 which is placed in parallel to the main electrodes 41, 42. The trigger capacitor 49 is charged from the low voltage 47 and does not require a portion of the high voltage as performed in the circuit of FIG. 4B. In both power supply configurations, as illustrated in FIGS. 4B and 4C, the discharge of the RSMA device 10 can be controlled remotely via the control input 54. Activation of the control signal discharged the trigger capacitor 49 across the primary of a trigger transformer 51 creating thousands of volts across the trigger electrodes 52, 53. This small trigger spark ionizes gas and allows the main capacitor 44 to discharge across the main electrodes 41, 42. This heats the gas within the RSMA device 10, causing it to be expelled as previously described. In both FIGS. 4B and 4C it is shown that the addition of the control input allows the discharge to be precisely timed with relation to the discharge of other devices or other external events.

It is therefore shown that the multi-electrode power supply designs, as illustrated in FIGS. 4A and 4B reduce the amount of power required at the very high breakdown voltage required to trigger the gap and as a consequence, reduce the weight, size, and cost of the electronics. The precise control of the trigger insures that the main capacitor 44 is fully charged to the same energy level each time. Thus the pulses initiated from the RSMA device 10 are reproducible in size and controlled in time.

V. Electrode Design

Figures 5, 5A, 5B, 5C:
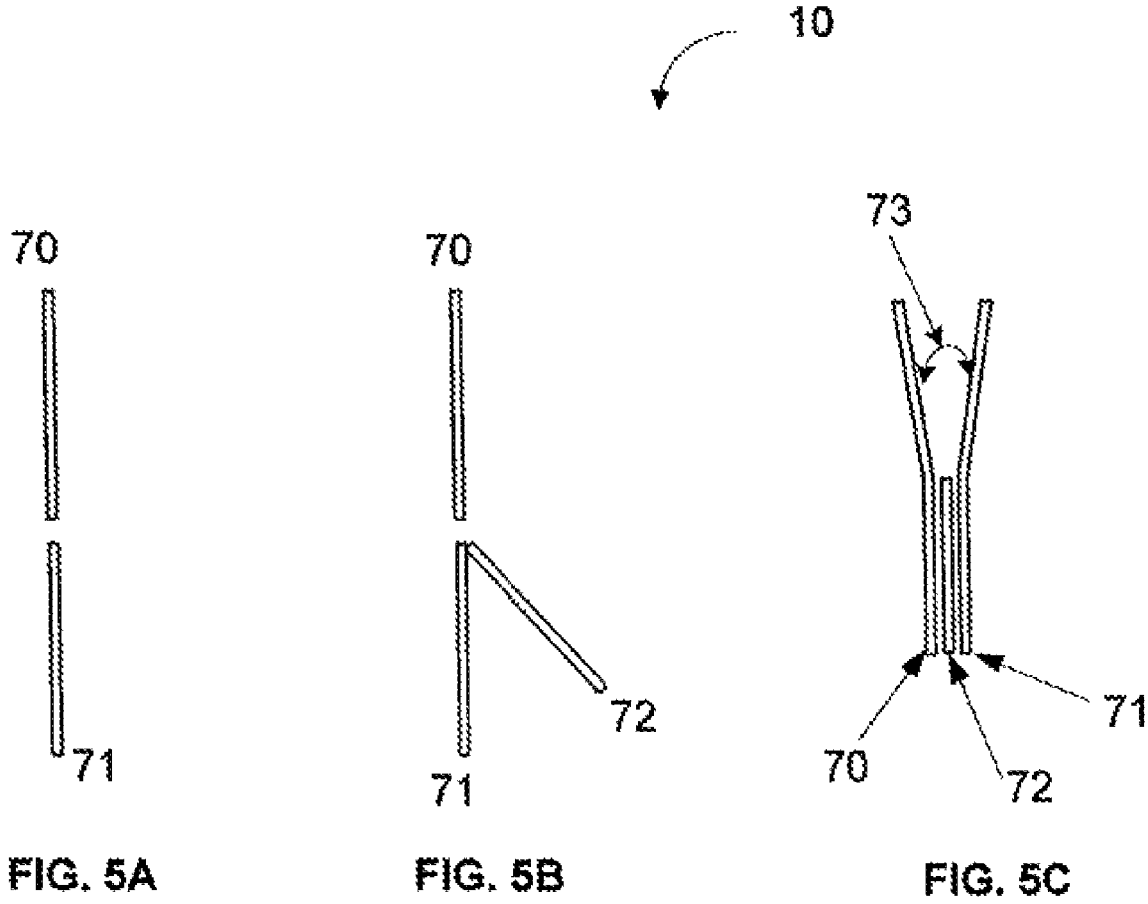
FIGS. 5*a*-5*c* are illustrations of three types of electrodes that can be used with the RSMA device of FIG. 1, according to one embodiment.

Electrode design is an important aspect of the RSMA device of the invention, FIG. 5A illustrates a basic two-electrode design, according to one embodiment. The two electrodes 70, 71 are connected to the main output of the power supply 41, 42. In operation, a repetitive arc occurs between the tips of the two electrodes 70, 71. Since the arc occurs at the electrode 70, 71 tips, the arc will remain at the tips, creating a localized hot spot on the tip of the electrodes. Localization of the arc will erode the electrodes over time and the electrode gap becomes undesirably wider. A wider gap will require an undesirably higher voltage to initiate further arcing. This greatly contributes to the non-repeatability of the two electrode design. To overcome these and other drawbacks, the invention further contemplates the use of a three electrode design which includes the two electrodes 70, 72 of the two electrode configuration plus an additional third electrode, referred to herein as a so-called "trigger" electrode, described as follows, as shown in FIGS. 5B and 5C, labeled 72. In operation, an arc is initiated when a trigger voltage, which is typically on the order of thousands of volts, jumps from trigger electrode 72 to main electrode 70. This ionizes a portion of the gas in the cavity 14 located between the two main electrodes 70, 71. This ionization of the gas causes the main capacitor 44 to discharge across the main electrodes 70, 71.

One advantage of the three-electrode embodiment is that only the output of the trigger transformer 51 (the transformer sourcing the trigger electrode 72) is required to be rated for thousands of volts.

It should be understood that while FIGS. 5B and 5C illustrate a single set of main electrodes 70, 71, in other embodiments, two or more sets of main electrodes 70, 71 can be serviced by a single trigger electrode 72. The geometry of the arrangement of three or more electrodes can be adjusted in three dimensions. One such arrangement is illustrated in FIG. 5C.

FIG. 5C shows the main electrodes 70, 71 bent outward in a vee shape while the trigger electrode 72 is placed between them. As described above, in operation, the trigger electrode 72 arcs to one of the main electrodes, e.g., electrode 71, thereby ionizing a portion of the gas between the electrodes 70, 71. This allows the main capacitor 44 to discharge in an arc 73 between the two main electrodes 70, 71. The arc will initiate at the point of closest proximity of the trigger electrode 72 to the main electrode 71. The magnetic forces (known as Lorentz forces) will cause the are 73 to move away from the source of current at the base of the main electrodes 70, 71 and to move out to the diverging tips of the main electrodes 70, 71. Beneficially, this movement of the arc will cause the arc to become longer which will allow for more efficient coupling of the heat from the arc into the gas. Additionally the movement of the arc will distribute the heat from the arc over a wider area of the electrodes which will greatly extend the life of the electrodes.

VI. Supersonic Flow Actuator Arrays

Figure 6:
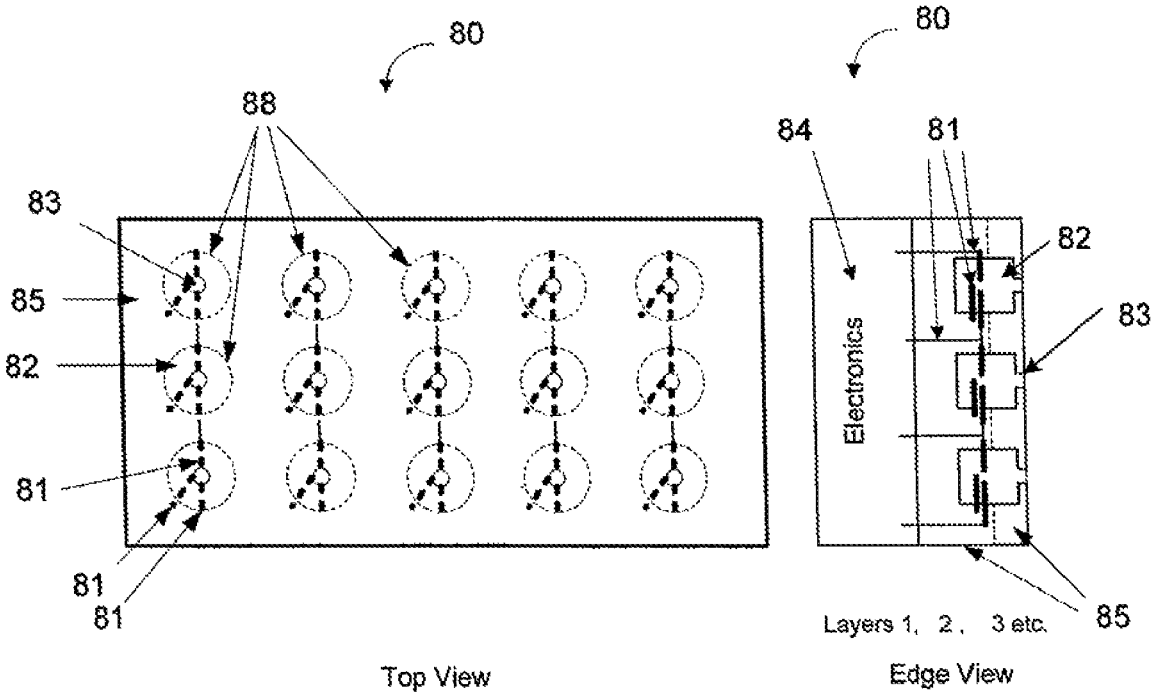
FIG. 6 is an illustration of the construction of an RSMA array showing a cutaway side view and a top view, according to one embodiment.

FIG. 6 shows respective top and side views of an array 80 of repetitive spark micro-actuators (RSMAs) 88. Each individual RSMA 88 is comprised of a cavity 82 typically formed from an inorganic insulator material. Each cavity 82 includes an orifice 83 to allow the bidirectional flow of air. Each cavity 82 also includes at least three electrodes 81 which support the arc inside of the cavity 82 and connect to the electronics 84 for power. The electronics 84 allows the operation of individual RSMAs 88 within the array or the operation of groups of RSMAs. A group may comprise a bank of RSMAs or a row or column of RSMAs.

In operation, the power supply electronics 84 generates a voltage of several hundred volts to simultaneously charge capacitors across the main power electrodes of each RSMA 88 in the RSMA array 80. Upon receiving a command from the electronics 84, a trigger signal is output to the trigger transformer within the electronics which creates a trigger voltage of several thousands of volts across the trigger electrode's. The voltage on the trigger electrodes ionizes enough air within the cavity to cause the breakdown voltage within the cavity to be lowered, resulting in the main capacitor discharging across the main power electrodes. This causes a rapid heating of the air within the cavity which rapidly increases the pressure within the cavity and causes air to be expelled out of the orifice 83 at supersonic velocities. After the high-temperature air has been discharged from the chamber, the ensuing pressure differential pulls fresh cool air in from outside of each RSMA device 88. At this point the RSMA device is ready to repeat the cycle.

The RSMA arrays 80 can be fabricated in a variety of ways. For example, in one embodiment, the body of the array 85 can be machined from one or more pieces of machineable ceramic material. Holes can be drilled to support the insertion of the electrodes and to form the orifice. The pieces thus machined can be joined to form an array in any shape or pattern desired.

In an alternative embodiment, the body of the array 85 can be formed by pressing ceramic powders in a mold to achieve the desired shape, cavities, orifices, etc and then fired to create the desired finished array. Electrodes can be inserted before or after firing as desired. Alternatively, individual sheets of ceramic powders held together with an organic binder can be punched with the needed cavities and orifices. Additional layers can have metal lines drawn upon them to form conductive traces and electrodes. These layers would be stacked onto one another to form a green tape stack which will create the total geometry desired. Next the stack would be fired in an oven to bake out the organic binder, leaving behind a solid block of ceramic containing the completed RSMA Array 80.

In another embodiment, the RSMA array 80 can be created by placement of ceramic potting material into a mold where it would be allowed to cure to create the final array housing part(s).

Figure 7A:
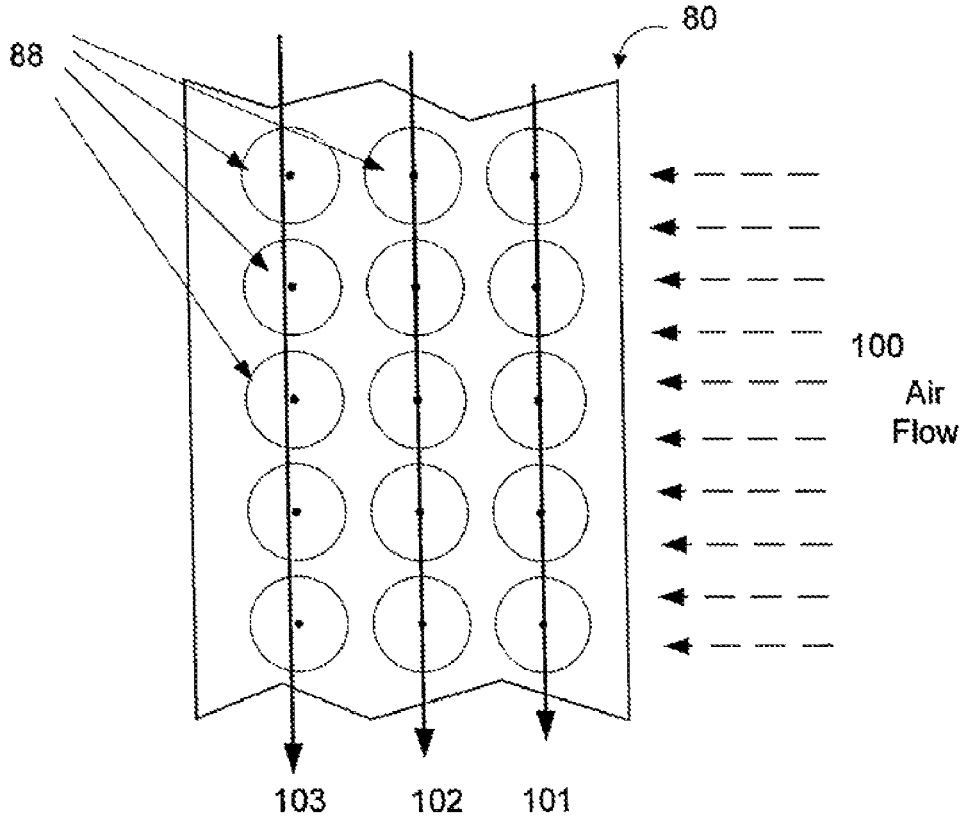
FIG. 7 is an illustration of the top and side view of an RSMA array operated in a programmed sequential manner, according to one embodiment.

FIG. 7*a* illustrates a top view of an RSMA array 80 where the air 100 is shown flowing across the surface from right to left. For case of explanation, the RSMA array 80 is shown with three rows of RSMAs 101, 102, and 103. It is understood, however, that there is no restriction on the number of rows that may be included in the RSMA array 80. A typical application may have, for example, tens or even hundreds of rows.

Figure 7B:
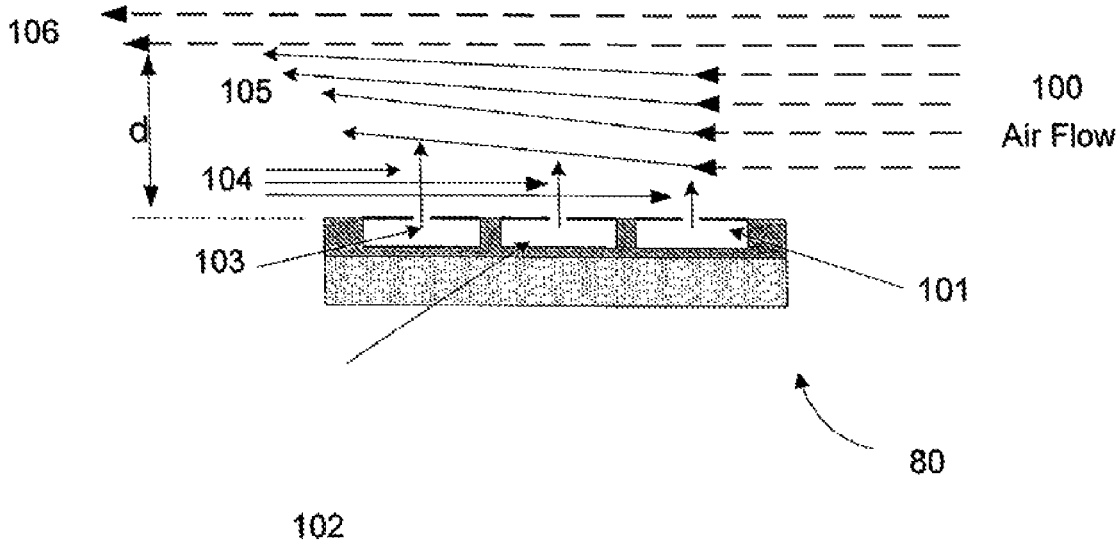

Referring now to FIG. 7*b,* there is shown a side view of the RSMA array of FIG. 7*a*. It can be seen that as the air 100 flows from right to left across the surface of the RSMA array 80, the flow is smooth at some distance "d" above the surface of the RSMA array 80. During the operation of the RSMA array 80, the array 80 generates a pulse of supersonic air 104 perpendicular to the surface over which the air 100 is flowing. When a leading row of RSMAs 101 of the RSMA array 80 is pulsed (i.e., activated) it promotes mixing within the boundary layer and, in some cases, causes the freestream lines to divert in an upward direction 105, thereby virtually changing the shape of the surface. It is understood that only one RSMA of the leading row of RSMAs 101 is shown in FIG. 7*b*. The other row members are aligned in the z-direction (i.e., into the page).

With continued reference to FIG. 7*b,* as further rows of RSMAs are pulsed in a linear sequence, the air 100 interacts with the pulsing effluent from the RSMAs, causing vortical structures to form and propagate downstream. These "disturbances" enhance mixing and energize the boundary layer so that (1) impending flow separation can be postponed (preventing the significant pressure drop along the surface to be encompassed by the separation zone) or (2) laminar-to-turbulent transition can be hastened.

Alternatively, if the rows are positioned at a different location on the aerodynamic surface and the rows of RSMAs 88 are pulsed in a sequence, the air 100 is diverted further upward from the surface. For example, rows 101, 102, 103, etc. . . . may be pulsed in a linear sequence to cause the air flow to be continuously diverted in an upward direction as shown. It should therefore be apparent that if the rows of RSMAs are rapidly pulsed in the sequence described, the diverted air 105 never has time to re-establish itself as a linear flow field.

Figure 8:
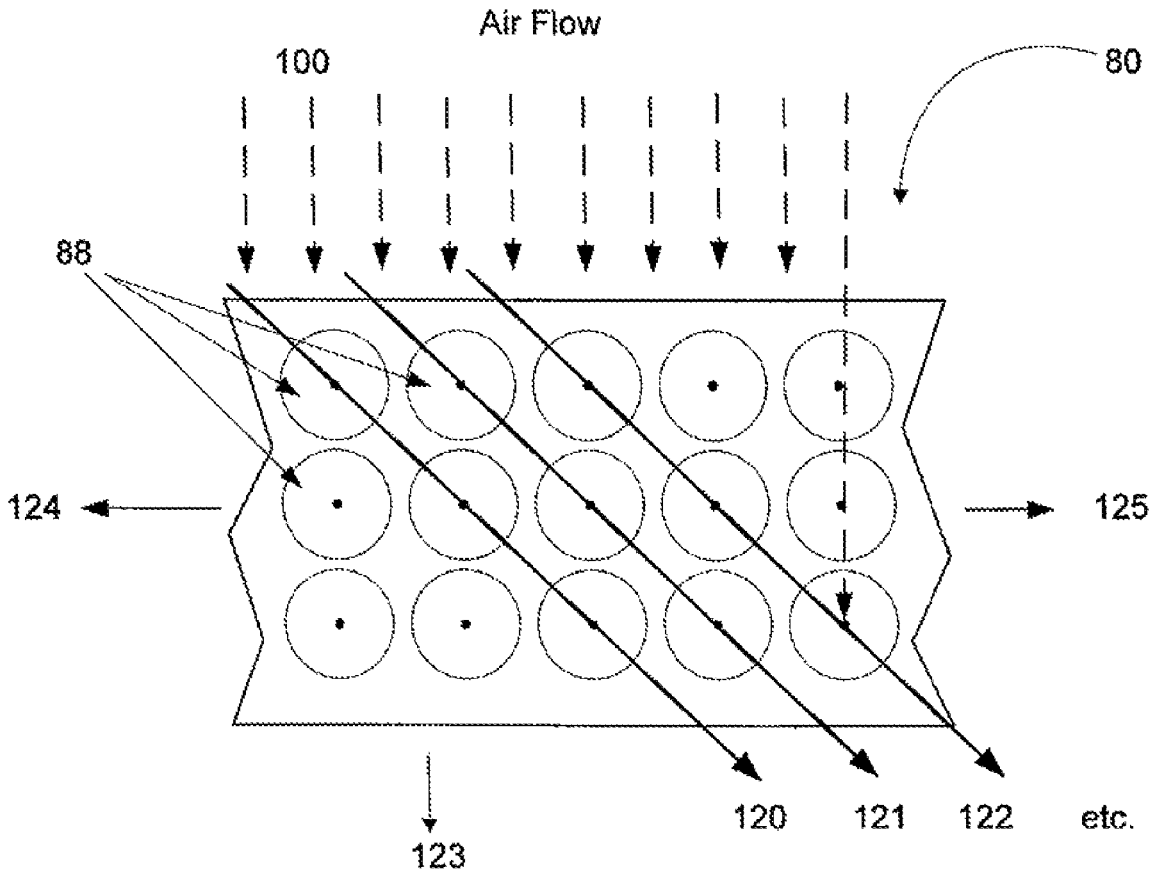
FIG. 8 is an illustration of an RSMA array operated in a vector steering manner, according to one embodiment.

FIG. 8 shows the top view of an RSMA array where the air flow 100 is approaching the RSMA array 80 from a vertical direction (i.e., from top to bottom across the surface). In this embodiment, the RSMA array 80 is electronically controlled so that the individual RSMA elements 88 are operated along rows 120, 121, 122, etc. diagonal to the air flow 100 to be used as a thruster. This is in contrast to the operation described above in which the rows were operated in a manner perpendicular to the air flow direction. It should be understood that while the air is lifted from the surface in the same manner described above, in the present embodiment, secondary effects come into play. Specifically, as the air flow 100 crosses individual RSMAs 88 it encounters the supersonic jets 104. As the air 100 is lifted by the exhaust of the RSMA 88, a portion of the air flow 100 will continue in the original direction 123, and a portion is diverted at an angle corresponding to the diagonal rows 120, 121, 122 and so on. This diversion of the air creates an opposing force vector 124 on the underlying RSMA array 80, causing the array 80 and its attached structure to desirably change its direction with respect to the approaching air.

It should be understood that the direction of the force vector 124 can be controlled by controlling the selection of the pattern in which the RSMA elements 88 in the RSMA array 80 are activated. By combining the control of displacing the boundary layer, discussed above with respect to FIG. 7 and force vector control, as presently described; it should be apparent that many aerospace applications can be realized. For example, varying amounts of boundary layer displacement could change the shape of an aerodynamic surface such as an airplane wing. This would allow control of the lift of the wing by the use of RSMA arrays rather than the use of the present wing flaps. As a further example, varying amounts of boundary layer displacement and force vectoring could allow RSMA arrays to replace the movable part of an airplane rudder. The astute reader can now readily envision other applications for such boundary layer and force vector control.

Figure 9A:
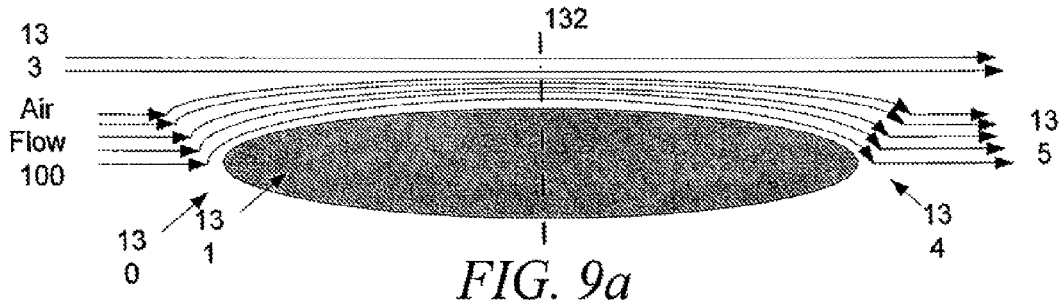
FIGS. 9*a*-9*c* are illustrations of the manner in which external aerodynamic flows may be manipulated in accordance with the invention.
Figure 9B:
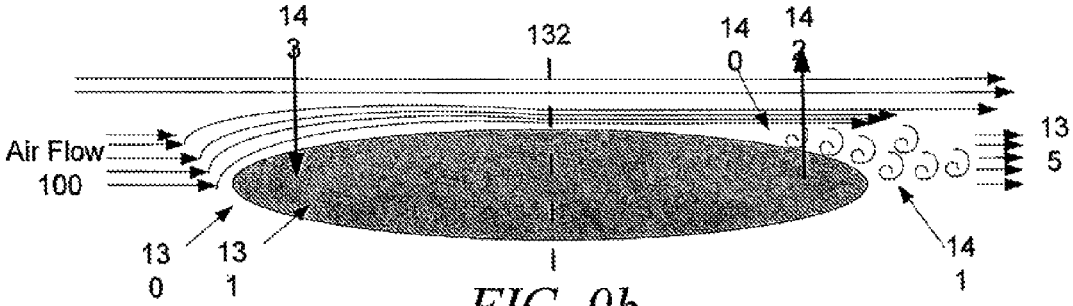
Figure 9C:
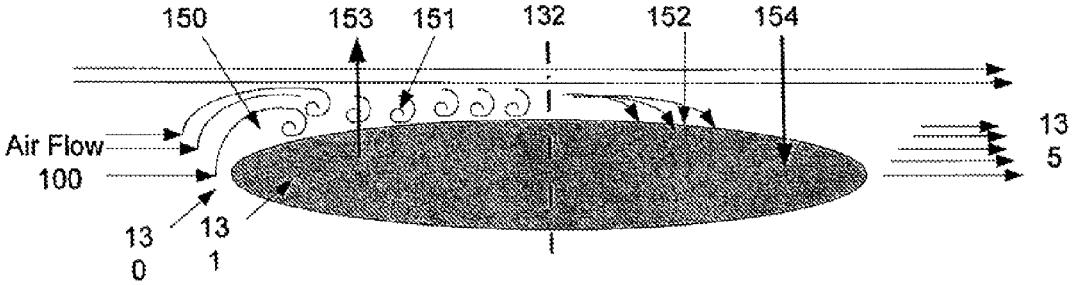

FIGS. 9*a*-9*c* are illustrations of the manner in which external aerodynamic flows may be manipulated in accordance with the invention.

A typical aerodynamic body 131 is shown in FIG. 9*a,* by way of example. Air 100 is shown flowing from left to right over the surface of the body 131 in the FIG. 9*a*. The air 133 not in line with the body 131 will flow smoothly from left to right. As the air 100 approaches the leading edge 130 of the body 131, the air is forced to change its horizontal movement and bend around the surface of the body 131. A portion of the air 100 will go over a top surface of the body 131 and another portion will go over the bottom surface of the body 131. The air in close proximity to the surface of the body 131 is affected by friction forces between the surface and the air and is termed the boundary layer. Ideally, it is desired that the air smoothly flow over both the top and bottom of the surfaces and remain attached to the surfaces until it passes the trailing edge 134 of the body 131 where it then resumes its horizontal flow 135. However, if the boundary layer becomes separated from the surface of the body 131 a region of constant pressure 140 is created, typically lower than the pressure if the flow were attached. Within this low pressure zone the air is recirculated and vortex shedding can occur. An unintentional separated flow causes an undesirable imbalance in pressure forces in the flow direction called pressure drag upon the aerodynamic body. This type of vortex shedding causes repetitive unsteady forces on the body which lead to structural fatigue on the aerodynamic structure. Additionally since the pressures on the aerodynamic body 131 are less on the trailing edge 142 than on the leading edge 143 the body 131 will experience a torque around some axis 132 causing the leading edge to be depressed 143 and the trailing edge to rise up 142.

If RSMA arrays are placed along the surface of the aerodynamic body 131 and activated in the appropriate pattern then the flow over the trailing edge would be affected is such a manner so as to reduce adverse boundary layer separation, thereby reducing drag. Alternatively, the RSMA array could be activated in such a pattern to increase drag, thereby slowing the aerodynamic body, and cause a torque around some axis resulting in changing the direction of flight without the use of moving structures.

FIG. 9*c* illustrates another case where the boundary layer becomes separated at the leading edge of the aerodynamic body 131. A low pressure area 150 is created which generates an area of re-circulating flow 151. At some distance down stream the boundary layer will transition from laminar to turbulent flow becoming reattached 152. Since the low pressure is on the forward edge an upward force will be generated 153. Similarly the high pressure will generate a downward force 154 causing the aerodynamic body 131 to experience a torque in the opposite direction from FIG. 9*b*.

It has been shown that the RSMA device of the invention can cause the boundary layer to shift upward, downward, or add angular momentum to the boundary layer. An understanding of how the flow characteristics change in the boundary layer in subsonic and supersonic flows over an aerodynamic surface allows placement of individual RSMA devices at critical locations on the surface. Once placed, subsequent activation of the RSMAs upon command beneficially changes the virtual, or effective, shape of the surface in accordance with the requirements of a particular application.

While the invention has been described with reference to an example embodiment, it will be understood by those skilled in the art that a variety of modifications, additions and deletions are within the scope of the invention, as defined by the following claims.

What is claimed is:

1. A flow control actuator device constructed of an inorganic ceramic insulator for creating a pulsating synthetic jet stream capable of causing a macro-scale flow effect, the device comprising:

a body;

a cavity respectively defined in the body and having a cylindrical orifice comprising a converging-diverging nozzle to enhance a flow characteristic of air entering and being discharged from said cavity respectively defined in a outer facing sidewall of said cavity to allow air to enter said cavity at a normal pressure and be discharged from said cavity at a supersonic velocity as a synthetic jet stream to cause said macro-scale flow effect, wherein said air is cyclically discharged from said cavity at said supersonic velocity in response to initiation means for repetitively initiating said electrical discharge within said cavity, said initiation means initiates said electrical discharge simultaneously within at least two or more devices within said array, said initiation means comprises a power circuit coupled to at least three electrodes, said power circuit for establishing a voltage potential sufficient to create said electrical current discharge between said at least three electrodes.

2. A device according to claim 1, wherein said device housing is constructed of a conductive material and wherein said electrodes are insulated from said body.

3. A device according to claim 1, wherein said orifice is centrally located on said outer facing sidewall of said cavity.

4. A device according to claim 1, wherein said at least three electrodes comprise: a first main electrode; a second main electrode configured for receiving a voltage from said power circuit and for transmitting said electrical discharge to said first electrode; and a trigger electrode for initiating said electrical discharge between said first and second main electrodes.

5. A device according to claim 1, wherein said electrical discharge is substantially in the range of 600 to 1000 volts.

6. A flow control actuator device for creating a pulsed synthetic jet stream capable of causing a macro-scale flow effect, the device comprising:

a device body constructed of one of a ceramic insulator or a conductive material, a cavity respectively defined in the body, a cylindrical orifice respectively defined in a outer facing sidewall of said cavity to allow air to enter said cavity at a normal pressure and be discharged from said cavity at a supersonic velocity as a synthetic jet stream to cause said macro-scale flow effect, wherein said cylindrical orifice is centrally located on said outer facing sidewall of said cavity, wherein said orifice further comprises a converging-diverging nozzle to enhance a flow characteristic of air entering and being discharged from said cavity, wherein said air is cyclically discharged from said cavity at said supersonic velocity in response to initiation means for repetitively initiating said electrical discharge within said cavity, and wherein said initiation means comprises: a power circuit coupled to at least three electrodes, said power circuit for establishing a voltage potential sufficient to create said electrical current discharge between said at least three electrodes, wherein said at least three electrodes comprise: a first main electrode; a second main electrode configured for receiving a voltage from said power circuit and for transmitting said electrical discharge to said first electrode; and a trigger electrode for initiating said electrical discharge between said first and second main electrodes, and wherein said electrical discharge is substantially in the range of 600 to 1000 volts.

* * * * *